United States Patent [19]

Bunnell

[11] Patent Number: 4,545,635

[45] Date of Patent: Oct. 8, 1985

[54] MATRIX CONNECTOR

[75] Inventor: Edward D. Bunnell, Palm Harbor, Fla.

[73] Assignee: AMP Incorporated, Harrisburg, Pa.

[21] Appl. No.: 543,591

[22] Filed: Oct. 19, 1983

[51] Int. Cl.[4] ..... H01R 11/20; H01R 23/66

[52] U.S. Cl. ..... 339/99 R; 29/751; 339/18 P

[58] Field of Search ..... 339/18 R, 18 P, 18 C, 339/18 B, 17 F, 97 R, 97 P, 98, 99 R, 176 MF, 198 R

[56] References Cited

U.S. PATENT DOCUMENTS 4,354,719 10/1982 Weidler ..... 339/99 R 4,425,019 1/1984 Pohl ..... 339/97 R

*Primary Examiner*—Neil Abrams

*Attorney, Agent, or Firm*—F. Brice Faller; Robert W. Pitts

[57] ABSTRACT

Electrical connector comprises a plurality of terminals having respective elongate plate portions which are mounted in parallel on a dielectric base. Each plate has a like plurality of wire receiving slots at like spacing, the slots of adjacent plates forming a like plurality of rows of slots, whereby wires in a planar array may be laid over respective rows and terminated to the plates as desired. A programmable tool for accomplishing termination is also disclosed.

4 Claims, 10 Drawing Figures

68
56
59
58
60
66
62
50
66
57
66
68
64
2
47
46
4
40
48
42
44
17
19
22
28
24
23
10
18
20
30
28
31
16
32
26
26

77
91
88
74
72
84
78
82
84
88
86
90
81
80
92
120
118
121
97
123
122
96
108
112
98
102
97
101
109
95
115
95
94
100
103
106
102
107

MATRIX CONNECTOR

BACKGROUND OF THE INVENTION

The present invention relates to an electrical connector having a matrix of contacts which are selectively connectable to respective wires.

Modular connectors of the type introduced as telephone jacks and their corresponding plugs are now finding use in multiple telephone systems and other communications equipment. These are generally used with wires in the form of flat cable to facilitate termination. The expanded usage has led to plugs and jacks with an increasing number of contacts, as well as flat cable with an increasing number of wires. Often it is desirable to have the wires in the cable which is connected to the plug electrically matable to wires in the cable which is connected to the jack in a different order. This may be accomplished by terminating the wires in the cable connected to the jack to the appropriate terminals in the jack. Principles disclosed in U.S. Pat. No. 3,877,771 et al may be so employed to this end; these would require arranging wires for termination to terminals integral with contacts in the jack as desired. As the dimensions of the jack and cable are quite small for manual operations, this could be quite time consuming and further introduces considerable possibility for error, especially when performed in the field. A connector which would receive the wires of a flat cable in the order of their arrangement in the cable, which wires could then be connected to respective terminals as desired, would be most desirable.

SUMMARY OF THE INVENTION

The present invention comprises a connector having a base with stamped and formed terminals therein having contact portions for mating with another connector, and wire receiving portions for termination to a plurality of wires of a cable. Each terminal has a like plurality of wire receiving portions which parallel the wire receiving portions of the adjacent terminal, whereby the wires can be dressed out so that each wire overlies a wire receiving portion of each terminal. The base has barrier walls with V-slots and retaining notches therein which aid in aligning the wires for termination to the desired terminal. A further aspect of invention is the specialized tool which receives the base with wires so arranged. The tool has wire inserters therein which are slidable so that any desired termination arrangement may be achieved.

The invention thus provides for a quick and relatively foolproof way for terminating a plurality n of wires to a like plurality of terminals in $n^n$ possible ways.

DETAILED DESCRIPTION OF THE PREFERRED EMBODIMENT

Figure 1:
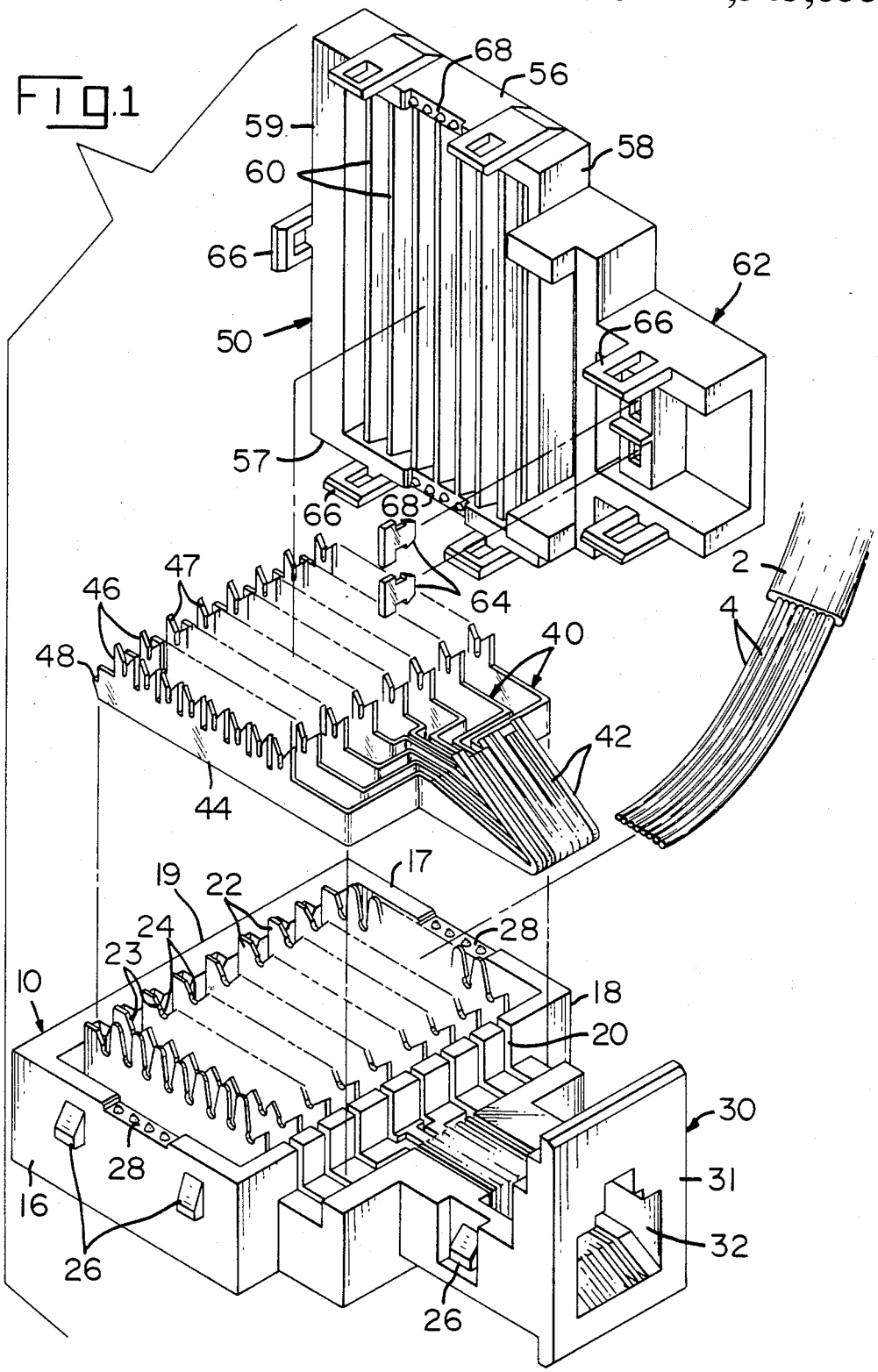
FIG. 1 is an exploded perspective of the connector.

FIG. 1 is an exploded perspective of the connector, which comprises a base 10 molded of plastic, eight stamped and formed metal terminals 40 which are received in base 10, and a cover 50 which is also molded of plastic. The object is to connect the eight individual wires 4 of flat cable 2 to respective spring contacts 42 as desired.

The base 10 comprises opposed first and second endwalls 16, 17 and opposed first and second sidewalls 18, 19 orthogonal to endwalls 16, 17. Nine barrier walls 22 extend between sidewalls 18, 19 parallel to endwalls 16, 17. Each barrier wall 22 has eight equal spaced V-slots 23 therein each of which is aligned with respective slots in adjacent walls. Each slot 23 has a retaining notch 24 in the bottom thereof which is sized to accommodate a wire 4. The base 10 further comprises a jack 30 with a plug receiving face 31 and eight slots 20 which are continuous from aperture 32 through first sidewall 18 and between barrier walls 22 to second sidewall 19. The slots 20 are profiled in a first surface 12, best evident in FIG. 5.

Referring still to FIG. 1, terminals 40 are formed from four different metal stampings which differ in length between the contact portions 42 and the plates 44. Each plate 44 has eight wire receiving portions 46 upstanding therefrom with respective wire receiving slots 47 therein. The slots 47 are equally spaced at like spacing as the slots 23 in each barrier wall 22. The terminals 40 are assembled to base 10 by inserting them into respective slots 20. Barbs 48 engage second sidewall 19 to retain the terminals 40 in base 10. The slots 47 align with slots 23 so that wires 4 will overlie slots 47 when fit into notches 24 in slots 23.

Cover 50 comprises first and second endwalls 56, 57 and first and second sidewalls 58, 59; the walls 56, 57, 58, 59 are spaced to fit against walls 16, 17, 18, 19 respectively of the base 10 to form a closed space containing terminals 40. Recesses 68 align with recesses 28 to provide access for cable 2 from two directions. Parallel ridges 60 which extend between endwalls 56, 57 are profiled to fit into slots 23 in barrier walls 22 to insert wires 4 into notches 24 (see FIG. 4). Latch arms 66 are situated to engage shoulders 26 to retain cover 50 on base 10. Metal shorting bars 64 are received in jack cover 62 and serve to shunt the longer spring contacts 42 when not in use (see FIG. 6).

Figure 2:
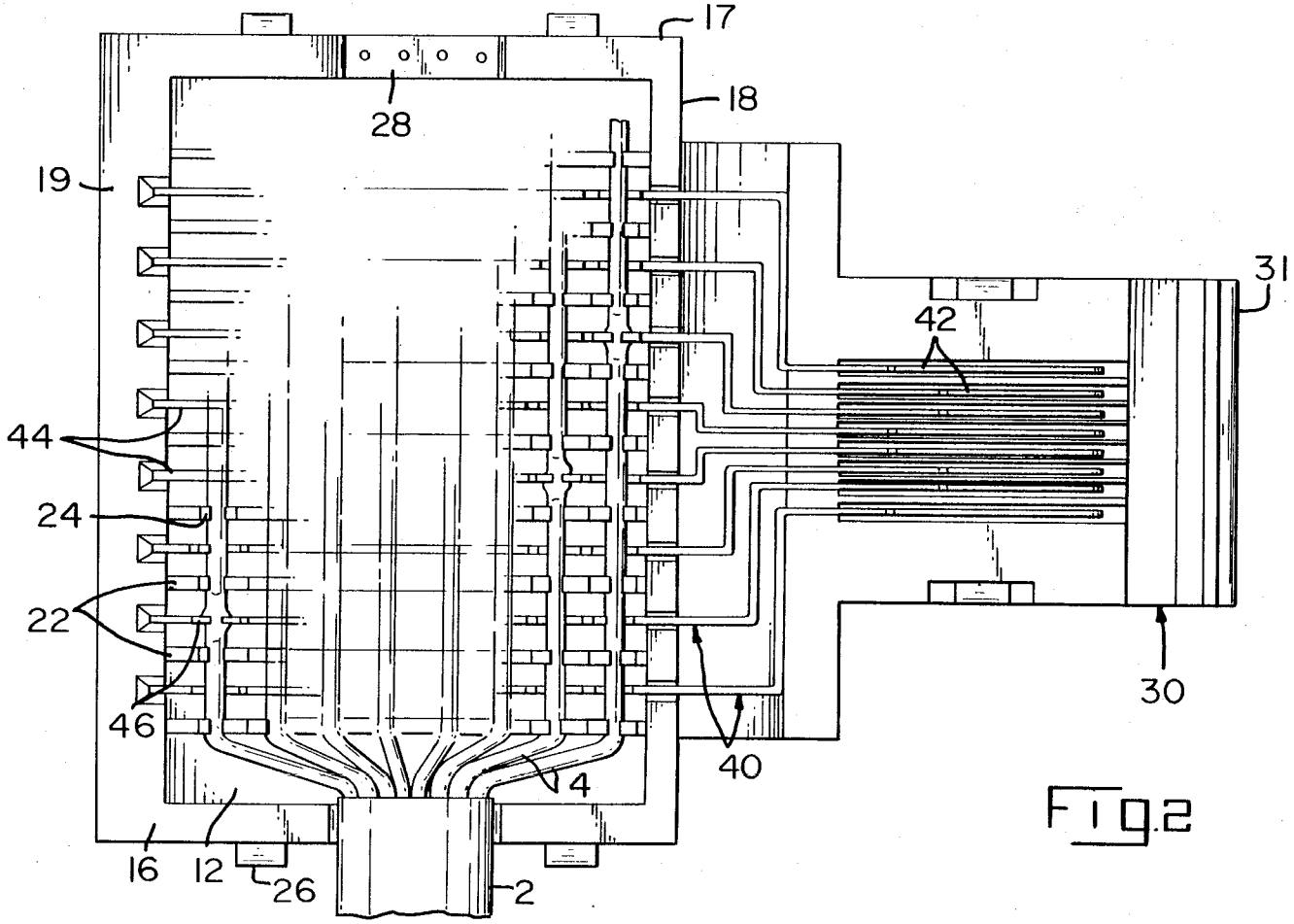
FIG. 2 is a plan view of the base with wires terminated to terminals.

FIG. 2 is a plan view of the wires 4 as terminated to terminals 40. The plates 44 extend upward from first surface 12, which is surrounded by walls 16, 17, 18, 19. Each wire 4 overlies a slot 47 in each plate 44, spaced therefrom by V-slots 23 in barrier walls 22, and is connected to the desired contact 42 by insertion in the appropriate slot 47. This is accomplished by a programmable hand tool which will be discussed in conjunction with FIGS. 7 to 10. This is a matrix scheme whereby the eight wires 4 are connected to the eight contacts 42 in $8^8$ or 16,777,216 possible combinations; this limitation is imposed by the tool, which has eight inserters each having eight positions.

Figure 3:
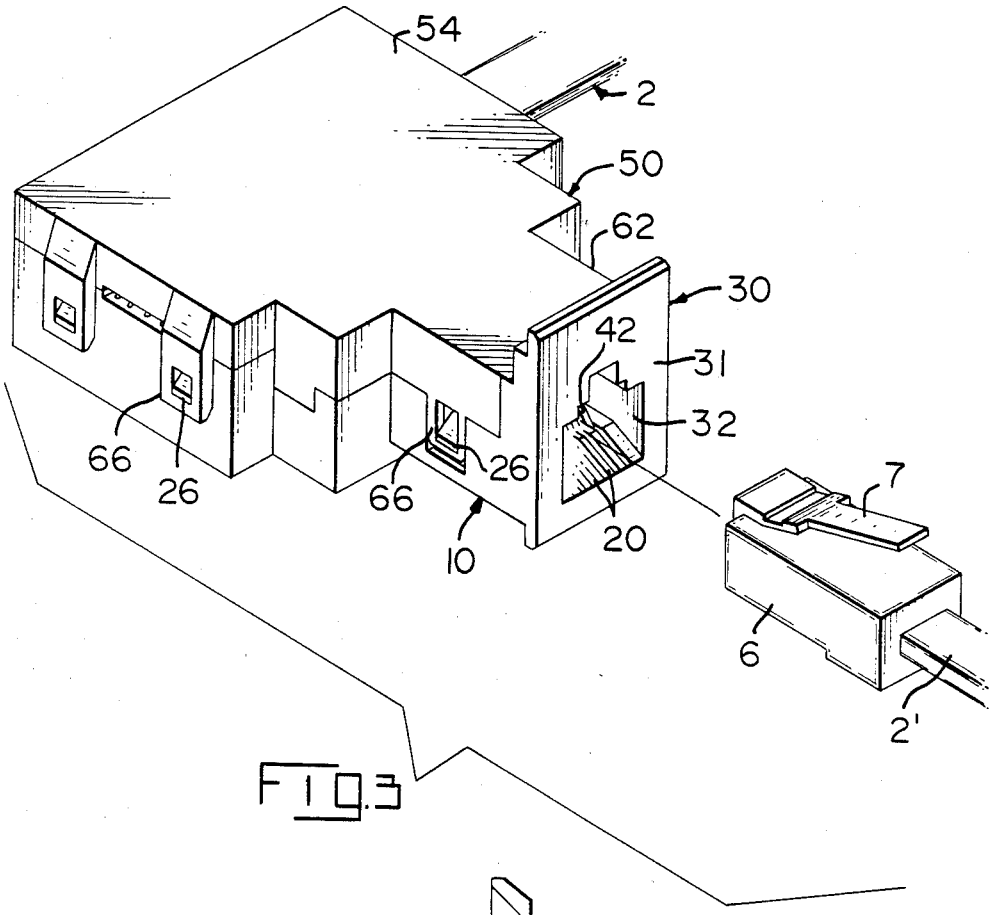
FIG. 3 is a perspective of the assembled connector.

FIG. 3 depicts the cover 50 latched to base 10 by means of latch arms 66 engaging shoulders 26. A modular plug 6 with latch 7 is poised for reception in aperture 32 of jack 30, where the spring contacts 42 are nested in respective slots 20.

Figure 4:
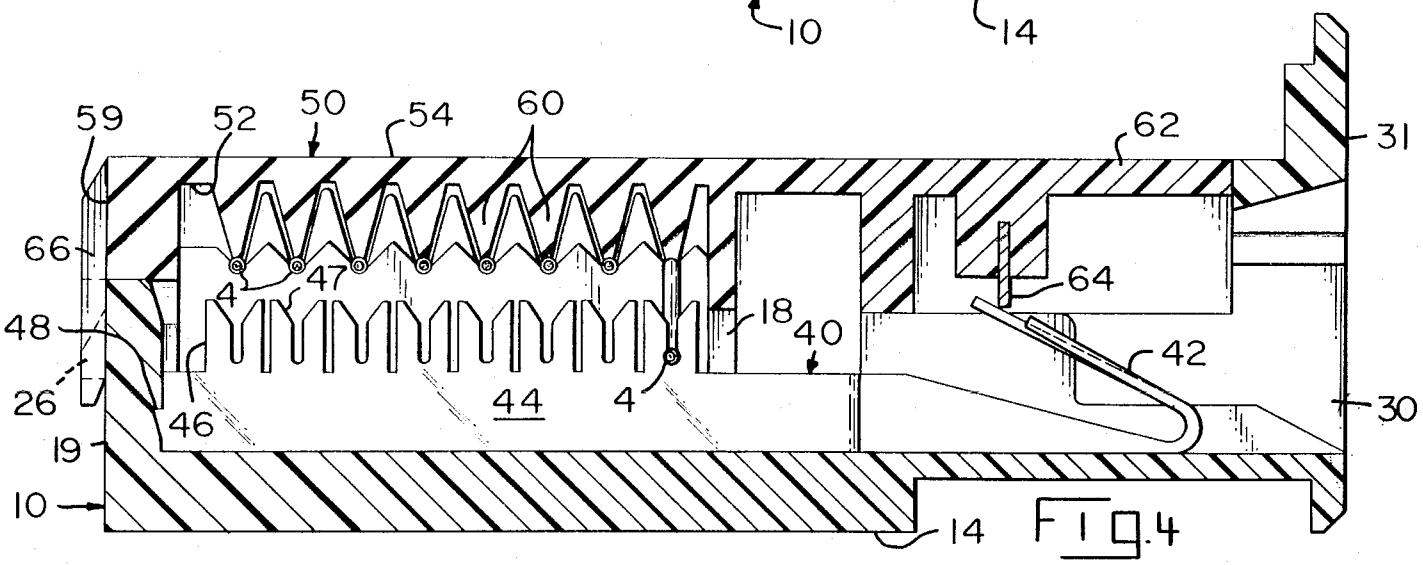
FIG. 4 is a cross section of the assembled connector.

FIG. 4 is a cross section of the assembled connector taken parallel to one of terminals 40. All of the wires 4 are nested in notches 24 at the base of V-slots 23 and retained therein by ridges 60; one of wires 4 has been inserted into a slot 47 which provides the lead-in to a wire receiving portion 46. Insulation is thus displaced to electrically connect the conductor in wire 4 to terminal 40. Note that the longer of contacts 42 are shunted across bars 64.

Figure 5:
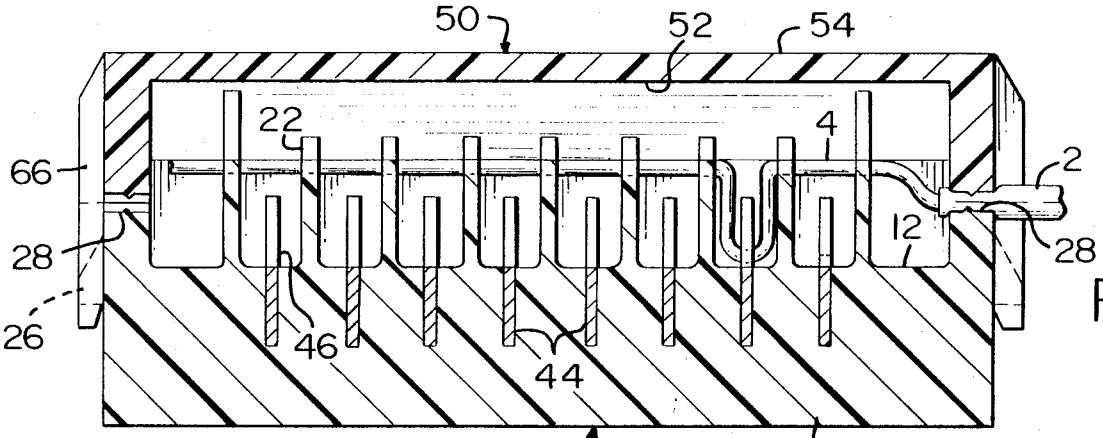
FIG. 5 is a cross section of the assembled connector.

FIG. 5 is a cross section of the assembled connector taken on a plane orthogonal to that of FIG. 4. The plates 44 are received in slots 20 in first surface 12 and extend into the base 10 toward second surface 14. The wires 4 lie on barrier walls 22, each wire 4 being inserted into a single wire receiving portion 46 of a respective terminal 40.

Figure 6:
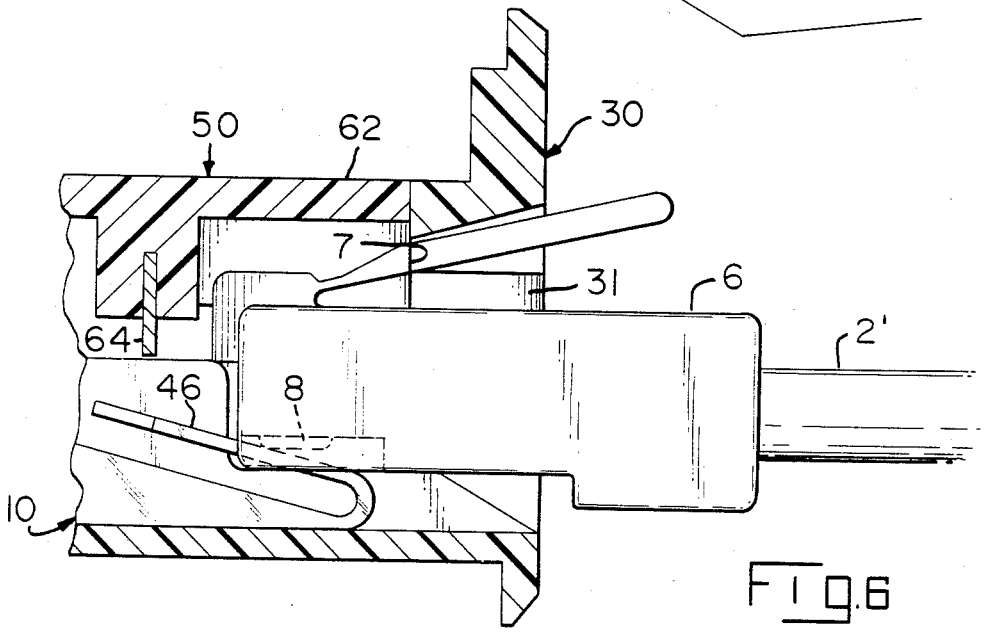
FIG. 6 is a cross section of the jack with the plug inserted therein.

FIG. 6 depicts a plug 6 on cable 2', as inserted into jack 30.

Figure 7:
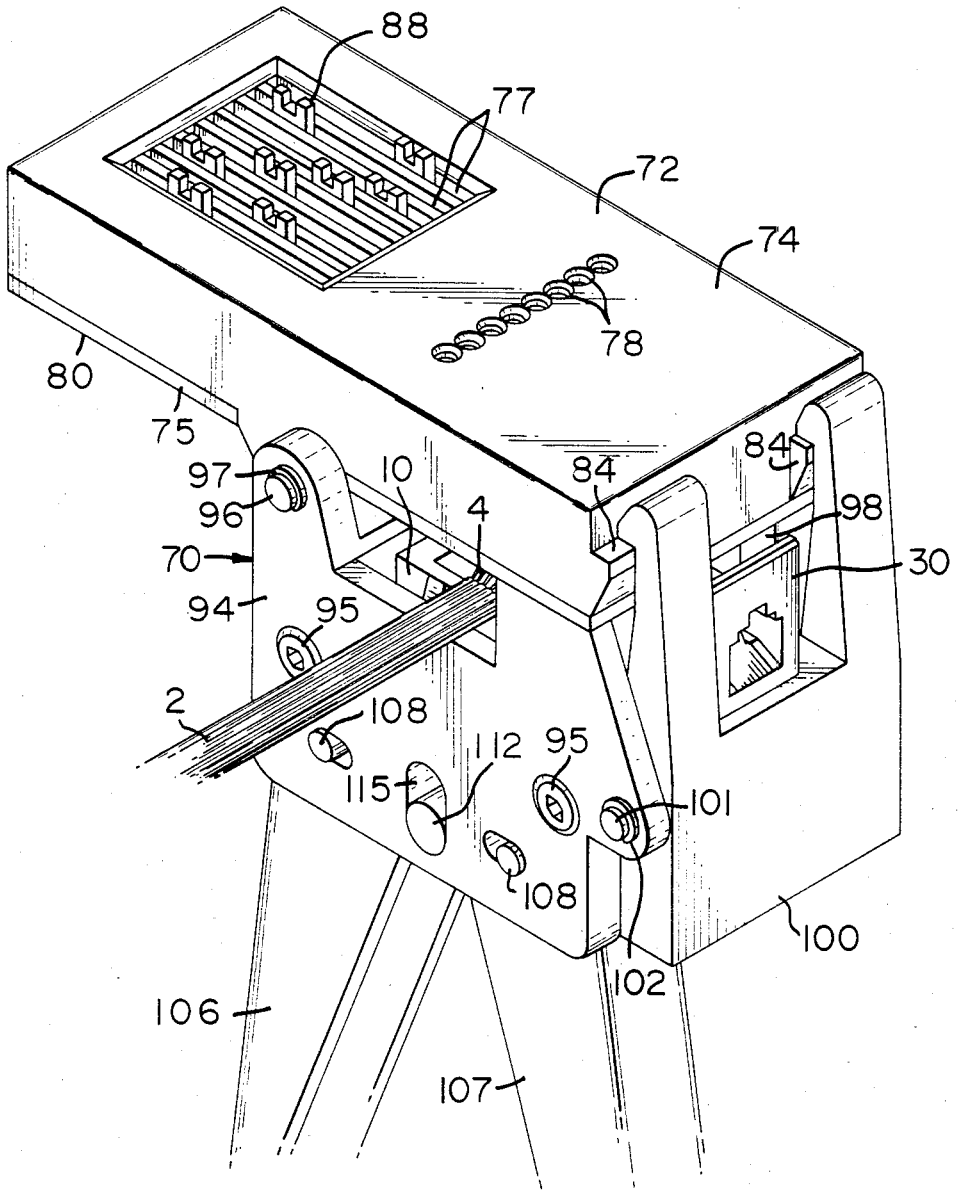
FIG. 7 is a perspective of the tool with the connector therein.

FIG. 7 is a perspective of the hand tool 70 used to terminate the individual wires 4 of cable 2 to the terminals in base 10, which is shown positioned in the tool 70 for termination. A hinged programmable cover 72 has eight parallel slots 77 therein from which indicators 88 protrude. The indicators 88 are slidable to eight positions. Bores 78 in top surface 74 are aligned with respective slots 77 and contain locking means for the indicators as will be described. The programmable cover 72 is hinged to housing 94 at pin 96 which is retained at opposite ends by ring clip 97. The housing 94, manufactured in two parts held together by screws 95, also has latch 100 hinged thereto by pin 101, retained by ring clip 102. Latch 100 holds the programmable cover 72 against the housing 94 as handles 106, 107 are squeezed to effect termination.

Figure 8:
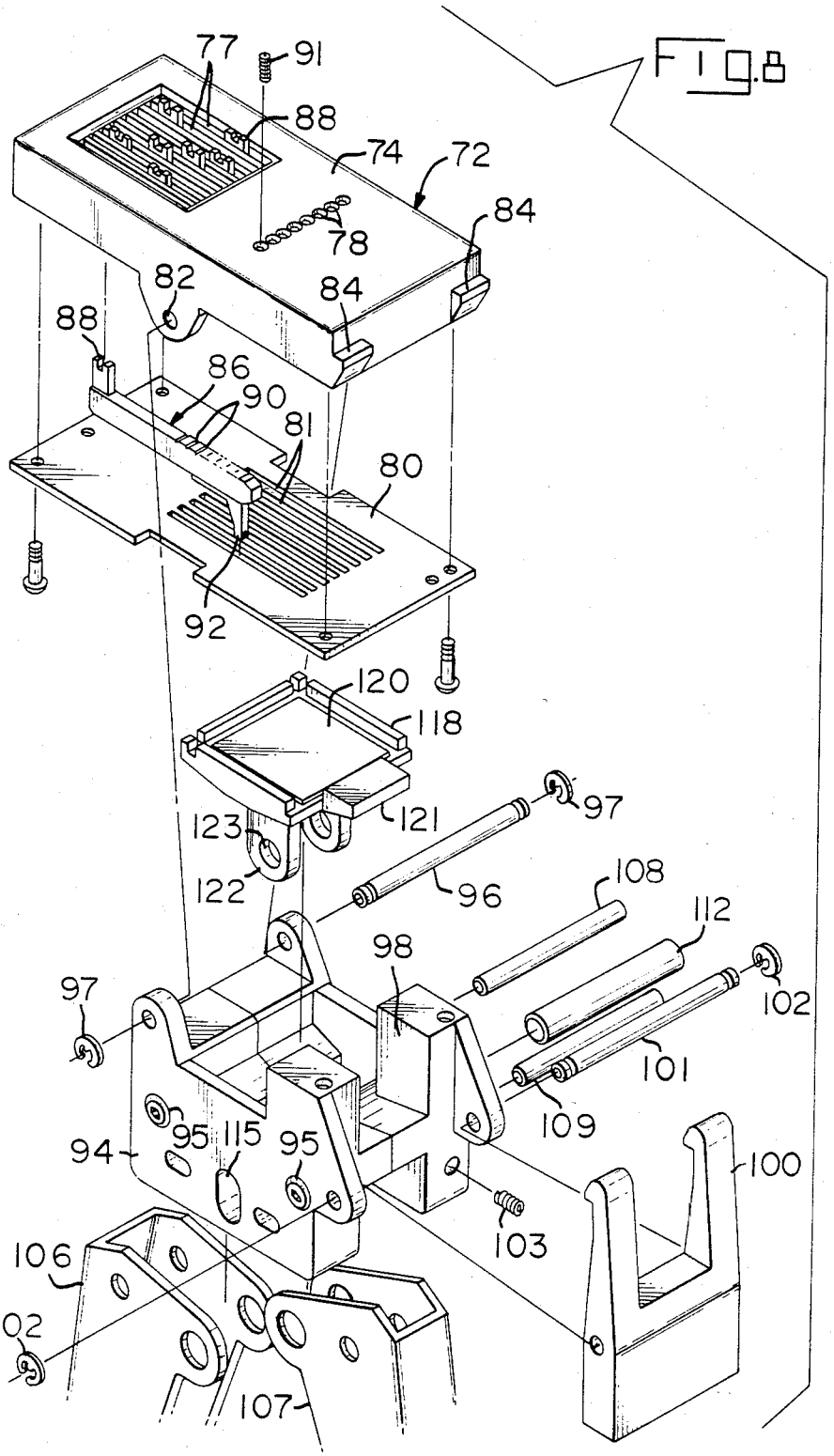
FIG. 8 is an exploded perspective of the tool.

FIG. 8 is an exploded perspective of the tool. Eight sliding program bars 86 each have an indicator 88 which is inserted upward through a respective slot 77. Each program bar 86 further has an inserter 92 extending downward from the other end thereof which is received in a respective one of eight slots 81 in retaining plate 80, which is screwed to programmable cover 72. Nest 118 has a platform 120 on which the connector 10 rests and a tongue 121 for the jack 30. Nest 118 has legs 122 with respective bores 123 therethrough which receive dowel pin 112 in a snug fit; the ends of the dowel pin 112 ride vertically in slots 115 as handles 106, 107 are squeezed together. The handles 106, 107 pivot about pins 108 to effect vertical movement of the nest 118, which in turn effects termination as will be described.

Figure 9:
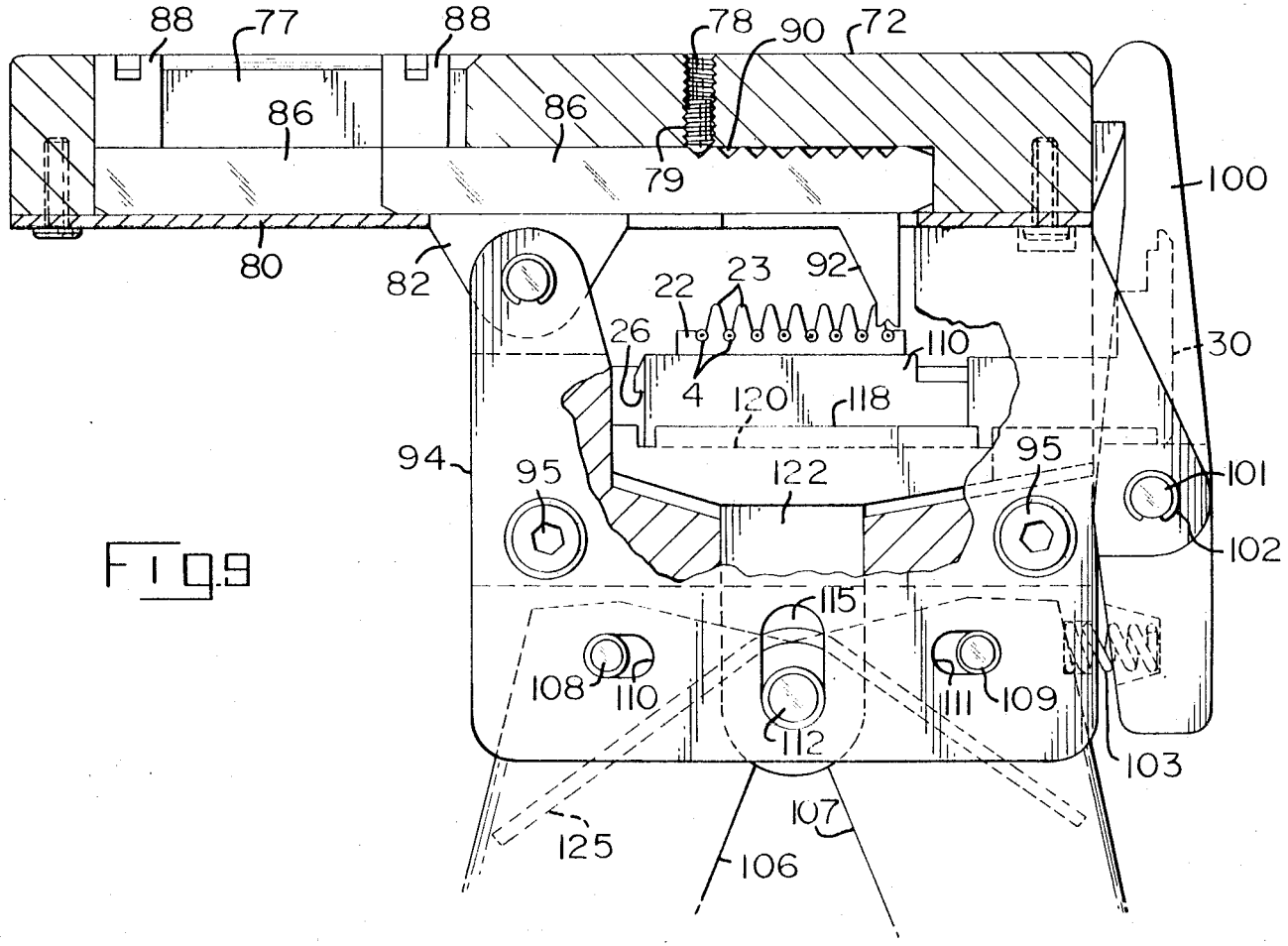
FIG. 9 is a cross section of the tool with the connector in place for termination.

FIG. 9 is a cross section of the tool 70, with base 10 positioned on platform 120 in nest 118, prior to termination. Program bars 86 have been programmed so that inserters 92 lie above the desired wire receiving portions 46 of terminals 40 (FIG. 1). The program bars 86 are held in place by ball plungers 79 in threaded bores 78. The latch 100 engages cover 72 to hold it stationary relative to housing 94, and spring 103 holds the latch in place. The arms housing 94 has horizontal elongate holes 110, 111 through which pins 108, 109 pass to engage round holes 124 125 in handles 106, 107. Handles 106, 107 also have round holes 126, 127 which receive the dowel pin 112 passing through slot 115.

Figure 10:
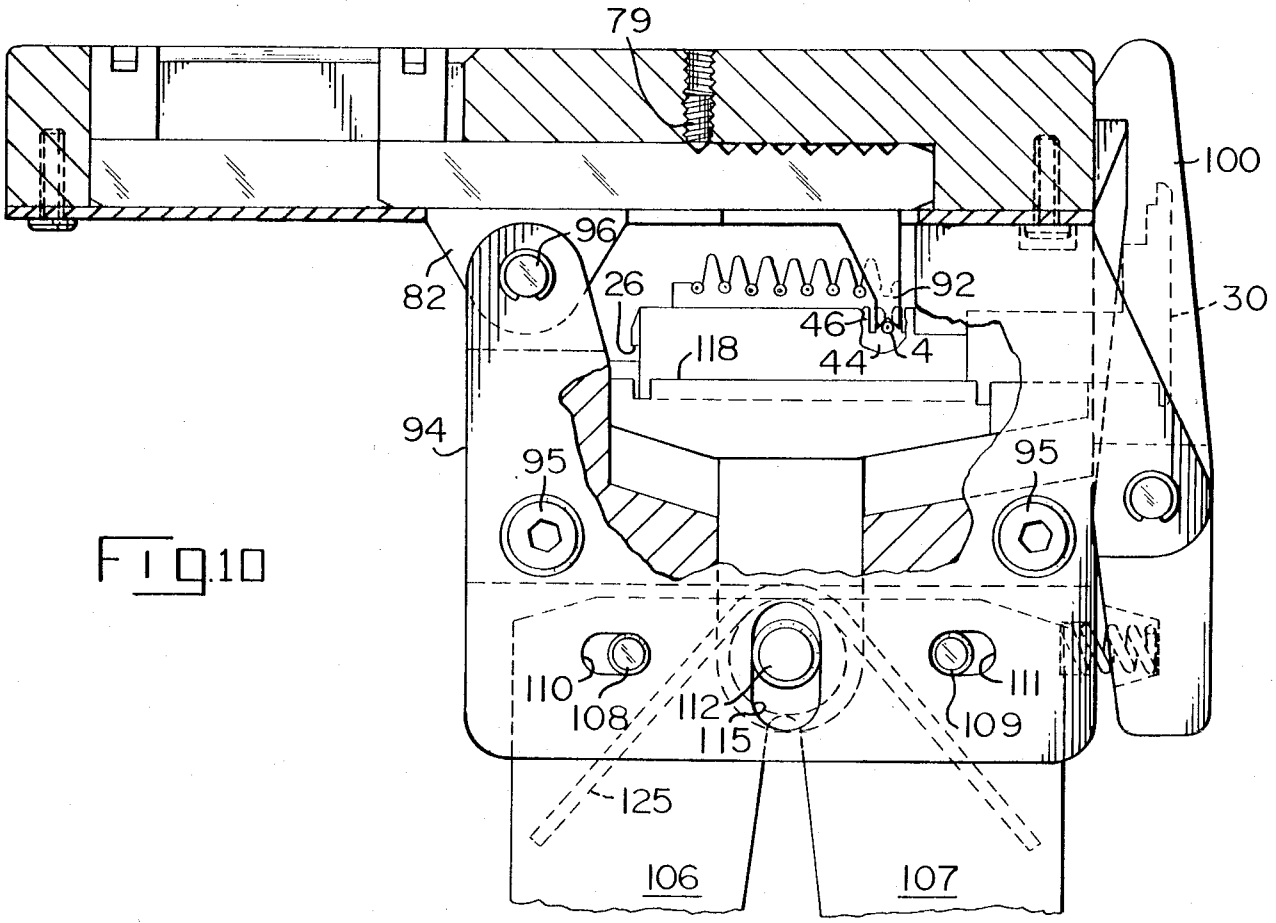
FIG. 10 is a cross section of the tool after wires are terminated to the connector.

FIG. 10 shows the tool as the wire 4 is forced into wire receiving portion 44 by inserter 92. This is effected by upward movement of nest 118 in response to squeezing handles 106, 107 together. The handles 106, 107 pivot about respective pins 108, 109 and force pin 112 upward, the ends thereof passing through slot 115 in housing 94. This forces the nest 118 upward to terminate the wire 4 and also causes the tops of arms 106, 107 to move slightly outward so that pins 108, 109 move outward relative to respective slots 110, 111. After insertion, the handles 106, 107 are released and the spring 128 urges them apart, which eases pressure on spring 103 to facilitate release of the latch 100 and removal of the connector.

The foregoing description is exemplary and not intended to limit the scope of the claims which follow.

I claim:

1. An electrical connector for programmable interconnection between a plurality of contacts and a like plurality of wires comprises:

a base of dielectric material having a first surface;

a plurality of conductive terminals mounted on said first surface, each said terminal being formed integrally with a respective contact each said terminal having an elongate plate portion with oppositely directed first and second edges, said plates being arranged in a substantially planar array with said first edges inserted into said first surface, each said second edge having a like plurality of wire receiving portions thereon having respective wire receiving slots at like spacing, said wire receiving portions extending away from said first surface, each said plate lying parallel to said other plates, said wire receiving slots of adjacent plates forming a like plurality of rows of slots, said base further comprises parallel barrier walls extending from said first surface, one barrier wall lying between each adjacent pair of plates, each barrier wall having a like plurality of slots therein, said slots in said barrier walls being aligned with said slots in said plates, said slots in said plates having wire lead-ins terminating closer to said first surface than said slots in said barrier walls whereby, said slots in said barrier walls serve to align said wires with said slots in said plates while keeping said wires spaced therefrom except where insertion tooling is applied, the barriers formed to support a portion of each said wire above and out of contact with certain ones of said plates while another portion of each said wire extending between two of the barriers is bent downwardly into a slot of another one of said plates, whereby, upon laying a like plurality of wires in a planar array against said base and perpendicular to said plates with each wire overlaying a row of slots in said terminals, any wire may be connected to any contact by inserting said wire into the underlying slot of the terminal having said contact.

2. An electrical connector as in claim 1 wherein said base further comprises a jack portion having said contacts therein, said contacts being in the form of reversely bent spring elements.

3. An electrical connector for making programmable termination of a plurality of wires in a cable by a like plurality of fixed terminals, said connector comprising:

a housing and a cover, both of rigid insulative material and defining therebetween a termination cavity, a cable passage traversing said cavity in a first direction, and a like plurality of parallel spaced terminal receiving grooves traversing at least said housing in a second direction normal to said first direction; a like plurality of terminals each formed by an elongated metal member having a first edge received in a respective terminal receiving groove and an opposite second edge extending into said cavity and defining a like plurality of insulation displacing profiles, at least one end of each said terminal defining a mating profile, and a plurality of barrier walls of insulative material mounted in said cavity extending in said second direction in parallel spaced fashion, the connector having one more barrier wall than terminals with a terminal being located between each pair of barrier walls, each said barrier wall defining a like plurality of wire receiving grooves aligned with respective insulation displacing profiles of said terminals, each wire receiving groove having a depth less than the insulation displacing profiles whereby wires traversing said cavity in said first direction are supported by said barrier walls; and whereby said terminals form a matrix array within said cavity with the number of terminals, insulation displacing profiles, and wires being equal, each wire being inserted into a single insulation displacing profile of a single terminal in accordance with a predetermined program, the barriers formed to support a portion of each said wire above and out of contact with certain ones of said terminals while another portion of each said wire extending between two of the barriers is bent downwardly into an insulation displacing profile of another one of said terminals.

4. An electrical connector according to claim 3 further comprising: a plurality of pusher members depending from said cover in a matrix array, each said pusher member aligned to push a wire into a respective groove of a barrier wall.

* * * * *